US006517372B1

(12) United States Patent
Jones

(10) Patent No.: US 6,517,372 B1
(45) Date of Patent: Feb. 11, 2003

(54) QUICK RELEASE SHOCK/VIBRATION CONNECTOR ASSEMBLY

(75) Inventor: Dennis B. Jones, Orange, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/033,613

(22) Filed: Dec. 26, 2001

(51) Int. Cl.[7] ..... H01R 13/625

(52) U.S. Cl. ..... 439/346; 439/159; 439/357; 439/352

(58) Field of Search ..... 439/346, 357, 439/358, 352, 159, 160, 157

(56) References Cited

U.S. PATENT DOCUMENTS 5,224,866 A * 7/1993 Nakamura et al. ..... 439/346
5,641,298 A * 6/1997 Holloway ..... 439/346
5,702,264 A * 12/1997 Endo et al. ..... 439/346
5,931,689 A * 8/1999 Patel ..... 439/346
6,048,222 A * 4/2000 Price ..... 439/358
6,257,925 B1 * 7/2001 Jones ..... 439/357
6,315,585 B1 * 11/2001 Oka ..... 439/157

* cited by examiner

*Primary Examiner*—Gary Paumen
(74) *Attorney, Agent, or Firm*—Wei Te Chung

(57) ABSTRACT

An electrical connector assembly (20) includes a male connector (30) and a female connector (40). The male connector includes a dielectric housing (50) with first latches (54), a plurality of contacts (60), a pair of levers (90) and a pair of springs (98). The levers are rotatably mounted in the housing, biased outwards by the springs. The female connector includes a female housing (70) having second latches (76) and a plurality of terminals (80). Each terminal has a mating portion in the shape of a tuning fork, with locking bosses (84) formed on ends of the tines (85). The male contacts each have dimples (64) defined in their mating portions. When the connectors are mated, the locking bosses of the terminals lock with the dimples of the contacts, forward walls of the female housing push against the levers, compressing the springs, storing a force to unmate the connectors, and the first and second latches lock together.

1 Claim, 10 Drawing Sheets

QUICK RELEASE SHOCK/VIBRATION CONNECTOR ASSEMBLY

BACKGROUND OF THE INVENTION

1. Field of the Invention

The present invention relates to an electrical connector assembly, and particularly to an electrical connector assembly that can meet high shock and vibration requirements, as well to an electrical connector assembly with a quick release design.

2. Description of the Related Art

Electrical connectors made for high shock/vibration environments are needed for automotive and other applications. Various mechanisms, such as quick release mechanisms, increase the usefulness of such connectors. To meet the requirements for a high shock/vibration environment, contacts of a mating pair of connectors have to exert large normal forces against their complementary mating contacts, and physical connection between mating contacts is desired at numerous points along the mating contacts. The high normal forces between contacts can make it difficult to separate mated connectors, creating an aggravation for a user. What is desired is a simple, inexpensive, and reliable pair of mating connectors which reliably function in a high shock/vibration environment, and yet which are relatively simple for a user to separate.

U.S. Pat. No. 6,315,585 B1 describes a connector assembly for use in an automobile. The connector assembly includes a male housing, a female housing which inserts into the male housing, and a casing into which the male housing fits. A key component of this invention is a pair of levers mounted to a top and bottom of the female housing, which interlocks with the male housing and casing during mating. A key problem solved by this invention is the problem of assuring that a coupling between the male and female housings is secure. This function is performed by ribs of the male housing pressing against springs mounted in the casing. If the mating is not secure, the springs push the connectors apart, rotating the levers and allowing the user to see that the connection is not secure. This invention has three major housings, each having a system of very complicated appendages, as well as many smaller pieces. The complexity adds cost.

A more simple, inexpensive solution for providing an electrical connector for use in a high shock/vibration environment is desired.

SUMMARY OF THE INVENTION

A first object of the present invention is to provide an electrical connector assembly which is reliable in a high shock/vibration environment.

A second object of the present invention is to provide an electrical connector assembly having a feature which aids in unmating.

A third object of the present invention is to provide an electrical connector assembly which is easily and cheaply manufactured.

An electrical connector assembly in accordance with the present invention comprises a male connector and a female connector. The male connector has a dielectric male housing with a pair of first latches, a plurality of contacts assembled in the housing, and a pair of levers and springs. The contacts each define a plurality of small dimples indented in a mating portion of the contact. The contacts protrude into a body of the male housing. The levers and springs are assembled into the housing so that the levers are each rotatable about an axis and each spring keeps a corresponding lever biased outwardly.

The female connector has a dielectric female housing and a plurality of terminals fixed within the housing. The female housing has a pair of second latches and a front barrel portion with a heavy sidewall. The mating portions of the terminals protrude into the barrel portion of the housing. Each terminal has a tuning fork shaped mating portion, with each of two tines of the terminal forming a pair of small locking bosses at a forward end thereof. A rear of each terminal has a compression sleeve for receiving a conductor of a cable therein to fix the cable to the terminal by crimping the sleeve.

When the male connector is mated with the female connector, the barrel portion of the female housing slides over the body of the male housing while the male contacts slide between the tines of the female terminals. When fully mated, the locking bosses of the terminals engage with the dimples of the contacts, and the side walls of the barrel portion depress the levers in the male housing, loading the springs, while at the same time the first latches of the male connector lock with the second latches of the female connector. When a user desires to unmate the electrical connector assembly, the second latches are pinched together by the user's fingers, unlocking the first and second latches. The force of the compressed springs is greater than the aggregate mating forces between the contacts and the tines, so the female connector is pushed away from the male connector, providing very simple unmating of the connector assembly.

Other objects, advantages and novel features of the invention will become more apparent from the following detailed description of the present embodiment when taken in conjunction with the accompanying drawings.

BRIEF DESCRIPTION OF THE DRAWINGS

FIG. 13 is a schematic cut-away of the electrical connector assembly of FIG. 1 in a fully mated position.

FIG. 14 is a close-up detail view of the schematic cutaway of FIG. 13, showing mating of the contacts and terminals.

DETAILED DESCRIPTION OF THE INVENTION

Figure 1:
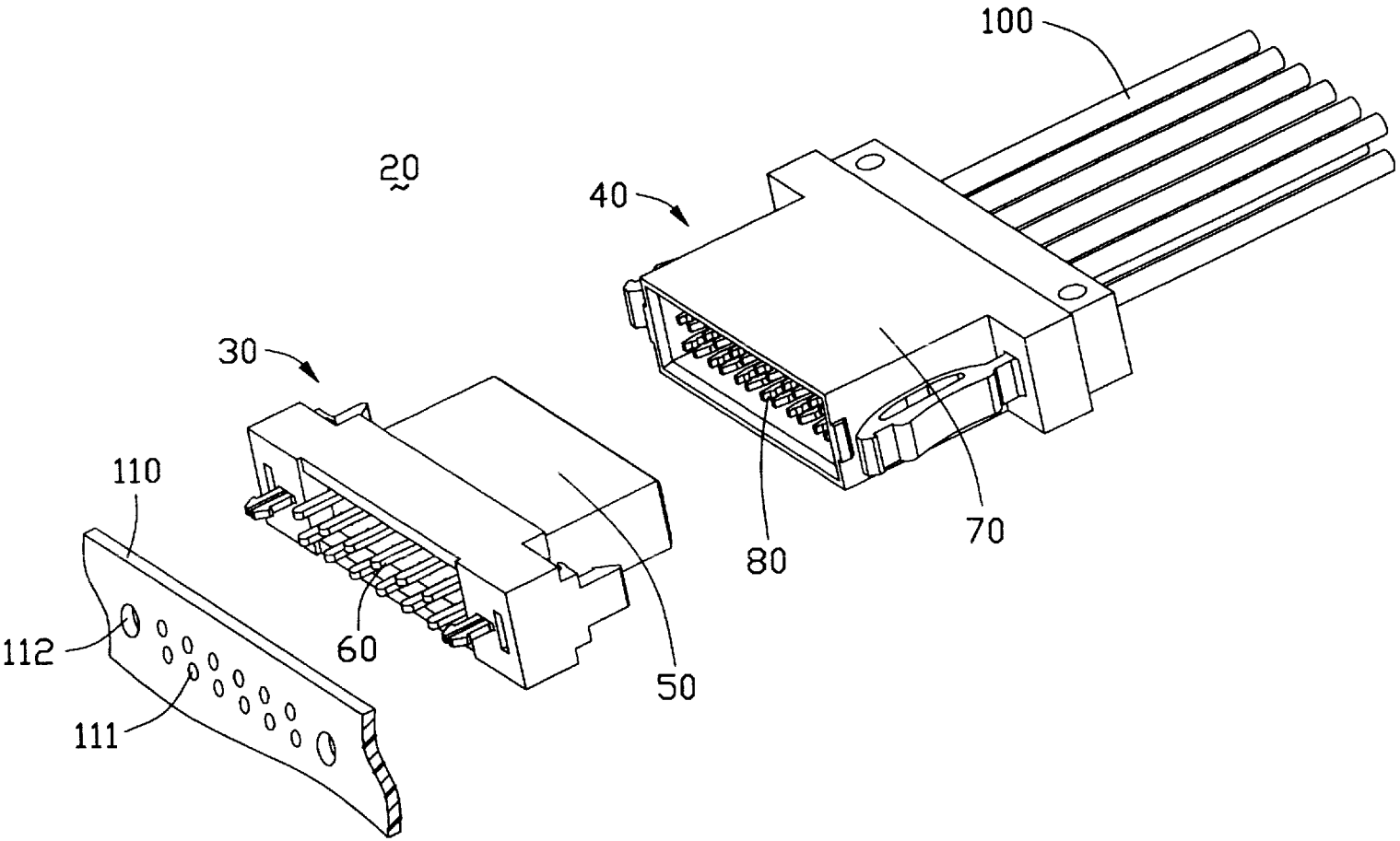
FIG. 1 is a perspective view of an electrical connector assembly in accordance with the present invention.

Referring to FIG. 1, an electrical connector assembly 20 in accordance with the present invention comprises a male connector 30 and a female connector 40. The male connector is mountable to a printed circuit board 110 and the female connector accepts attachment of cables 100.

Figure 2:
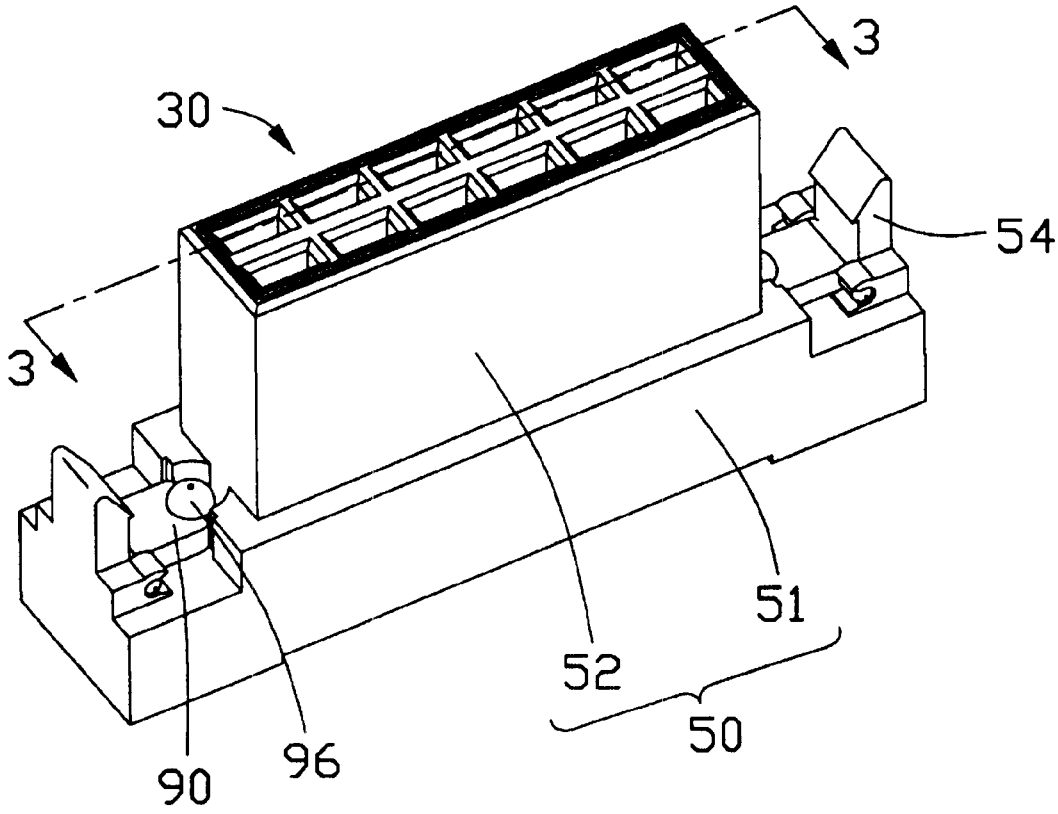
FIG. 2 is a perspective view of a male connector of FIG. 1, from a frontal aspect.
Figure 3:
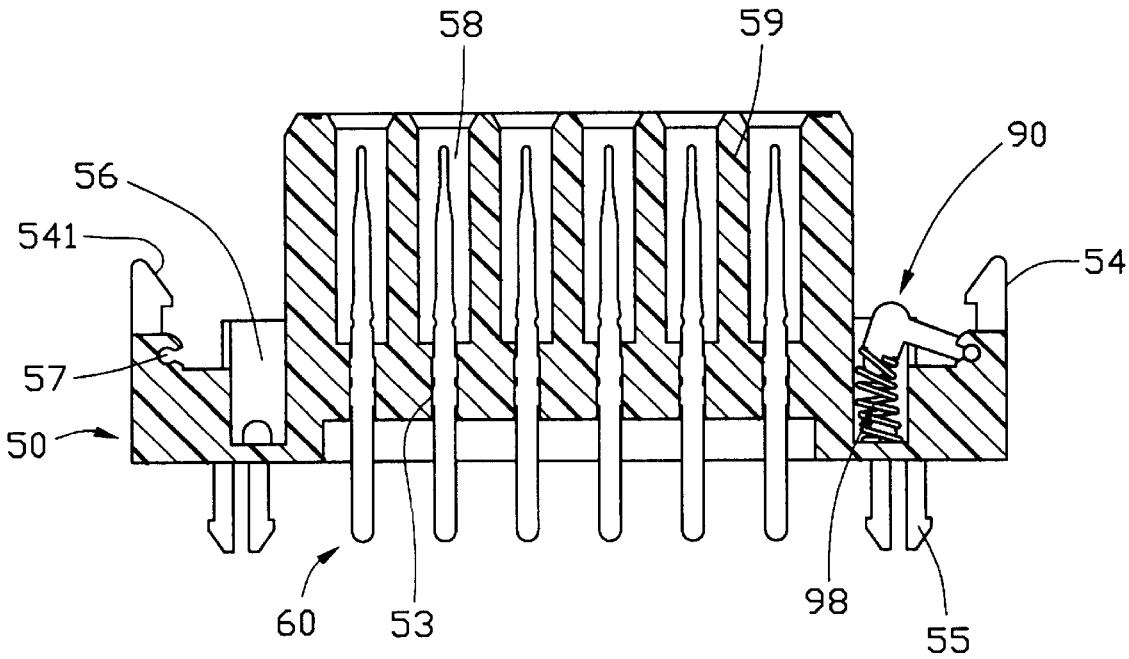
FIG. 3 is a cross sectional view of the male connector taken along line 3—3 of FIG. 2.

As shown in FIGS. 2–3, the male connector 30 comprises a dielectric male housing 50, a plurality of contacts 60, a pair of levers 90, and a pair of springs 98. The male housing 50 has an elongate base 51 and a rectangular body 52. The base 51 defines a plurality of fitting holes 53 therethrough for insertion of the contacts 60. A first latch 54 protrudes in a forward direction at either end of the base 51. A pair of boardlocks 55 protrudes from a rear side (not labeled) of the base 51.

The base defines a well 56 at either end adjacent and inboard of a corresponding first latch 54. A pair of eyelets 57 is formed at a rearward portion (not labeled) of each of the first latches 54, the eyelets of a given pair sharing a common axis. A first hook 541 is formed at a forward end of each first latch 54. The body 52 forms a plurality of channels 58 therein, each channel 58 being separated from other channels 58 by separating walls 59. Each channel 58 aligns with a corresponding fitting hole 53.

Figure 4:
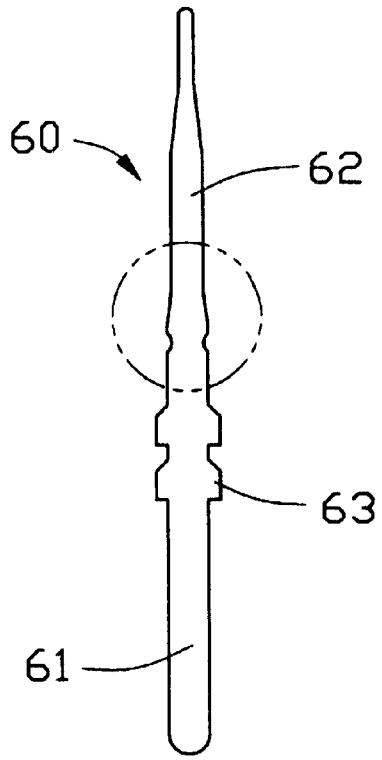
FIG. 4 is a plan view of a contact for the male connector of FIG. 2.
Figure 5:
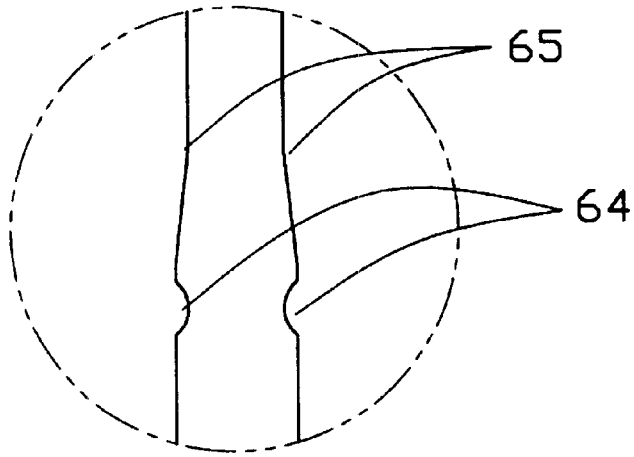
FIG. 5 is a close-up detail view of a mating portion of the contact of FIG. 4.

Referring to FIGS. 4–5, each electrical contact 60 has a mating portion 62 at a front end and a mounting portion 61 at a rear end. Barbs 63 along both sides thereof allow each contact to have an interferential fit with a corresponding fitting hole 53 of the male housing 50. A pair of dimples 64 and a pair of transitions 65 is formed in the sides of each mating portion 62.

Figure 6:
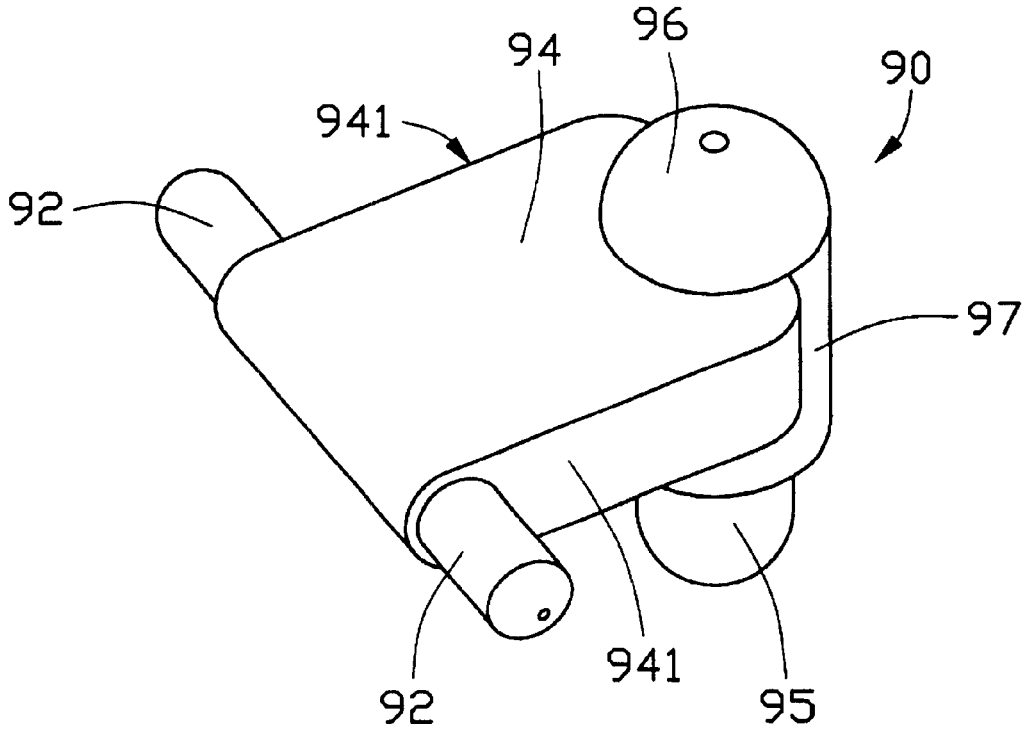
FIG. 6 is a perspective view of a lever of the male connector of FIG. 2.

FIG. 6 shows the lever 90 comprising a pair of axle stubs 92, an arm 94, and a cylinder 97, the cylinder having a spring seat 95 and a push knob 96 at either end. The axle stubs 92 each project horizontally from a rearward portion of a corresponding arm side 941. The axle stubs are co-axial. The cylinder is formed at a forward portion of the arm 94 and has a longitudinal axis perpendicular to that of the axle stubs 92. The spring seat 95, which has the shape of an elongate dome, extends downwardly from the cylinder 97. The push knob 96 protrudes upwardly from the cylinder 97, and opposite to the spring seat 95. The helical springs 98 each have an inner diameter slightly smaller than a diameter of the spring seat 95 of the lever 90. Each helical spring 98 is designed to provide a large force outward, along the central axis of the helix, under compression.

Figure 7:
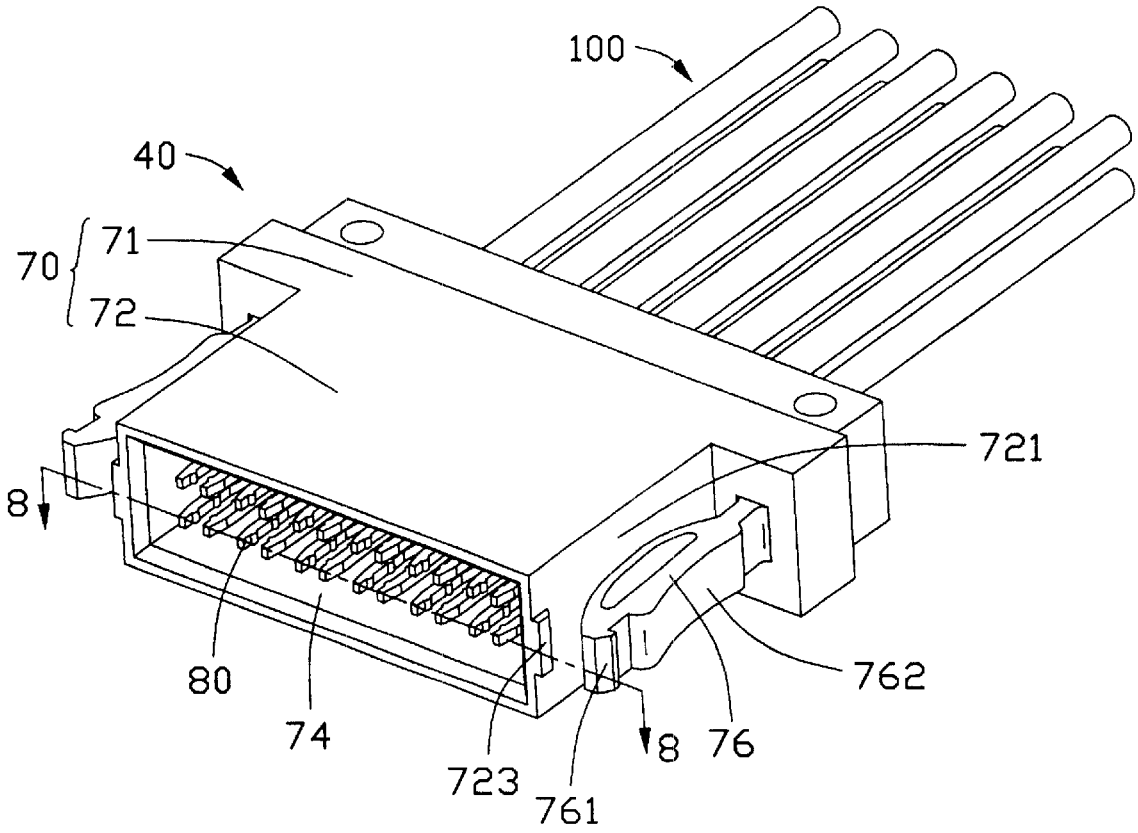
FIG. 7 is a perspective view of the female connector of the electrical connector assembly of FIG. 1, from a frontal aspect.
Figure 8:
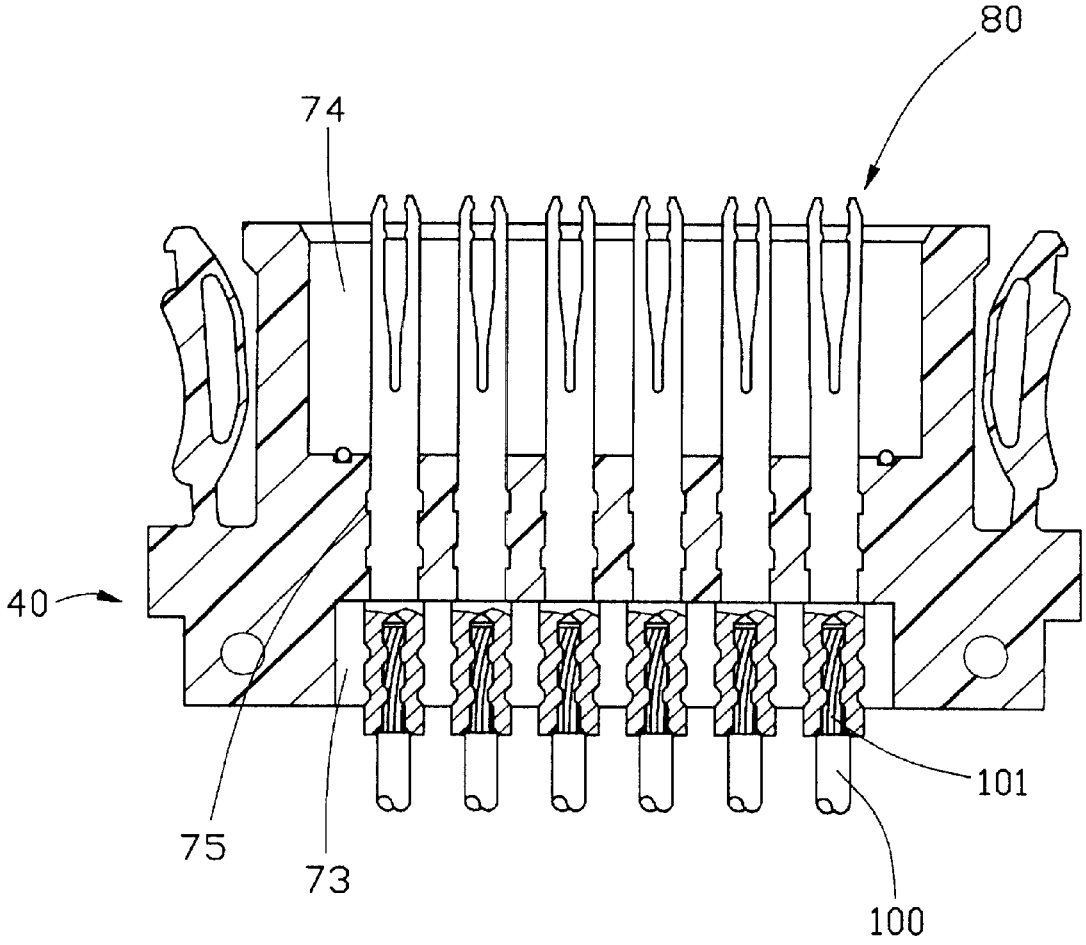
FIG. 8 is a cross sectional view of the female connector taken along line 8—8 of FIG. 7.

As shown in FIGS. 1, 7 and 8, the female connector 40 has a dielectric female housing 70 and a plurality of electrical terminals 80 mounted within the female housing 70. The female housing 70 has an elongate, rectangular fixing portion 71 with a cavity 73 defined in a rear of the fixing portion 71. A barrel portion 72 having a rectangular cross-section protrudes forwardly from the fixing portion 71. A receiving chamber 74 is defined within the barrel portion 72 and in front of the fixing portion 71. Two opposite side walls 721 of the barrel portion 72 are thickly constructed and are reinforced with a ram 723 located at a front end of each side wall 721. A plurality of fixing holes 75 are defined through the fixing portion 71 and through a rearward end of the barrel portion 72, the fixing holes 75 being in communication with the cavity 73 and with the receiving chamber 74. A pair of second latches 76 protrudes forwardly from two sides of the fixing portion 71, positioned at the sides of the barrel portion 72. A forward tip of each second latch 76 forms a second hook 761 and a middle of each second latch 76 forms a curved actuation portion 762 shaped to accommodate a user's fingers.

Figure 9:
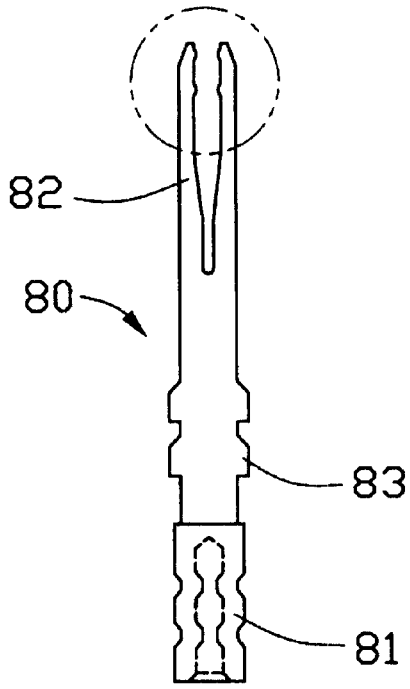
FIG. 9 is a plan view of a terminal for the female connector of FIG. 7.
Figure 10:
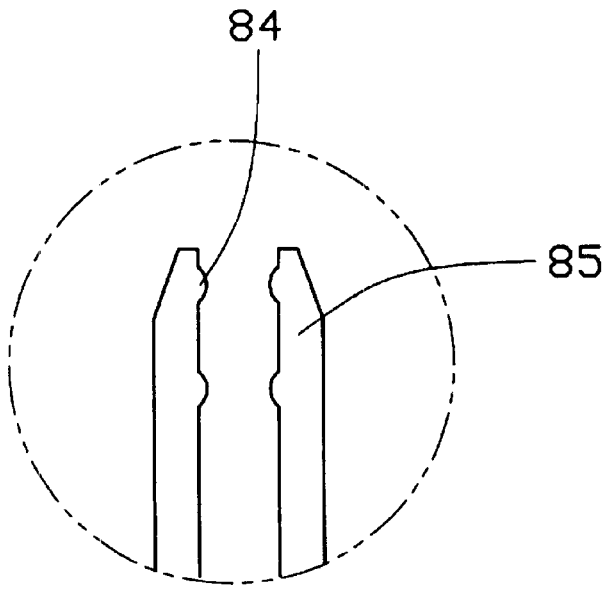
FIG. 10 is a close-up detail view of a mating portion of the terminal of FIG. 9.

Referring now to FIGS. 9 and 10, the terminals 80 each have a mating portion 82 in the shape of a tuning fork at a front end (not labeled) and a crushable hollow sleeve 81 at a rear end (not labeled). The mating portion 82 has a pair of symmetrically formed, resilient tines 85 opposing one another. Each tine 85 forms a pair of locking bosses 84 on an inward face of the tine 85. A pair of barbs 83 is formed just in front of the sleeve 81 for having an interferential fit with the fixing holes 75 of the female housing 70.

In assembly, referring to FIG. 8, cables 100 are stripped at their front ends exposing conductors 101, each of which is inserted into the sleeve 81 of a corresponding terminal 80. The sleeve 81 is then crimped, firmly fixing the cable 100 to the terminal 80. Each terminal 80 is then inserted through and has an interferential fit with a corresponding fixing hole 75 in the female housing 70. In this position, the mating portions 82 of the terminals 80 extend toward a front (not labeled) of the barrel portion 72.

The springs 98 are each attached to a corresponding lever 90, a forward part of the spring encircling the spring seat 95 of the lever 90. Each lever 90 is then assembled to the male housing 50, with the spring 98 fitting into a corresponding well 56 of the male housing 50, and the axle stubs 92 of the lever 90 engaging with the corresponding pair of eyelets 57 of the male housing 50. The plurality of contacts 60 is then inserted through the fitting holes 53 and into corresponding channels 58. The male connector 30 can then be mounted to the printed circuit board 110, the boardlocks 55 fitting into the large holes 112 and the mounting portions 61 of the contacts 60 fitting into the small holes 111 of the printed circuit board 110. The contacts 60 are soldered to the printed circuit board 110 using through-hole techniques.

Figure 11:
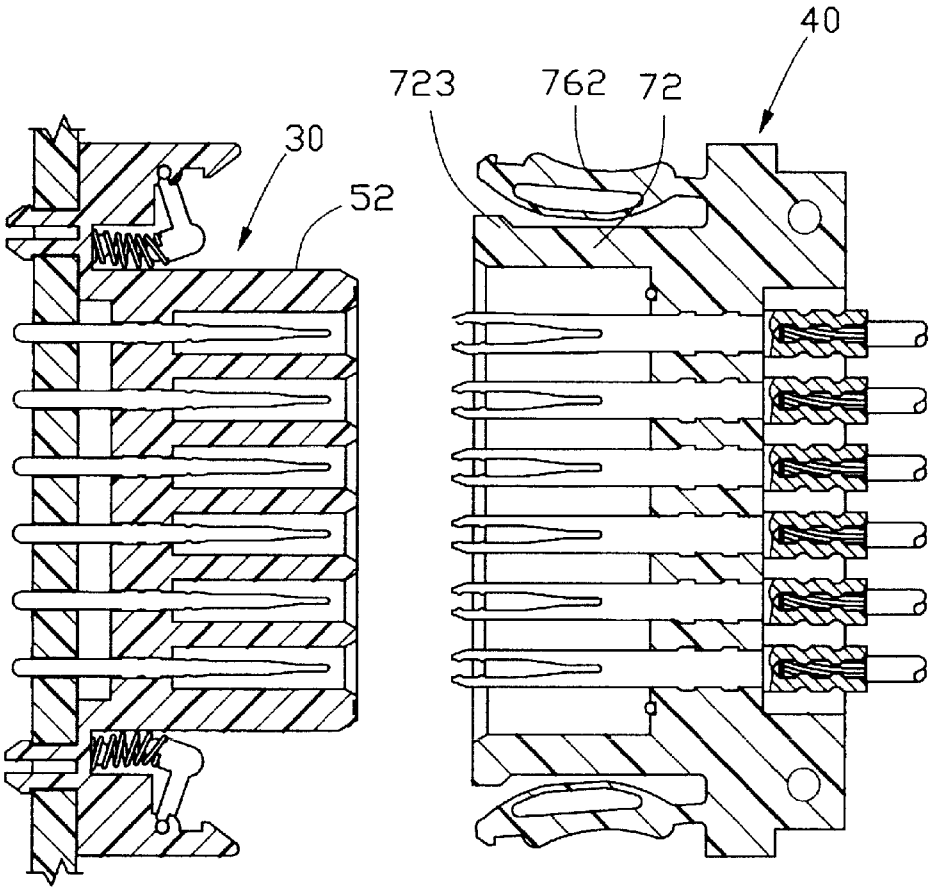
FIG. 11 is a schematic cut-away of the electrical connector assembly of FIG. 1 prior to mating.
Figure 12:
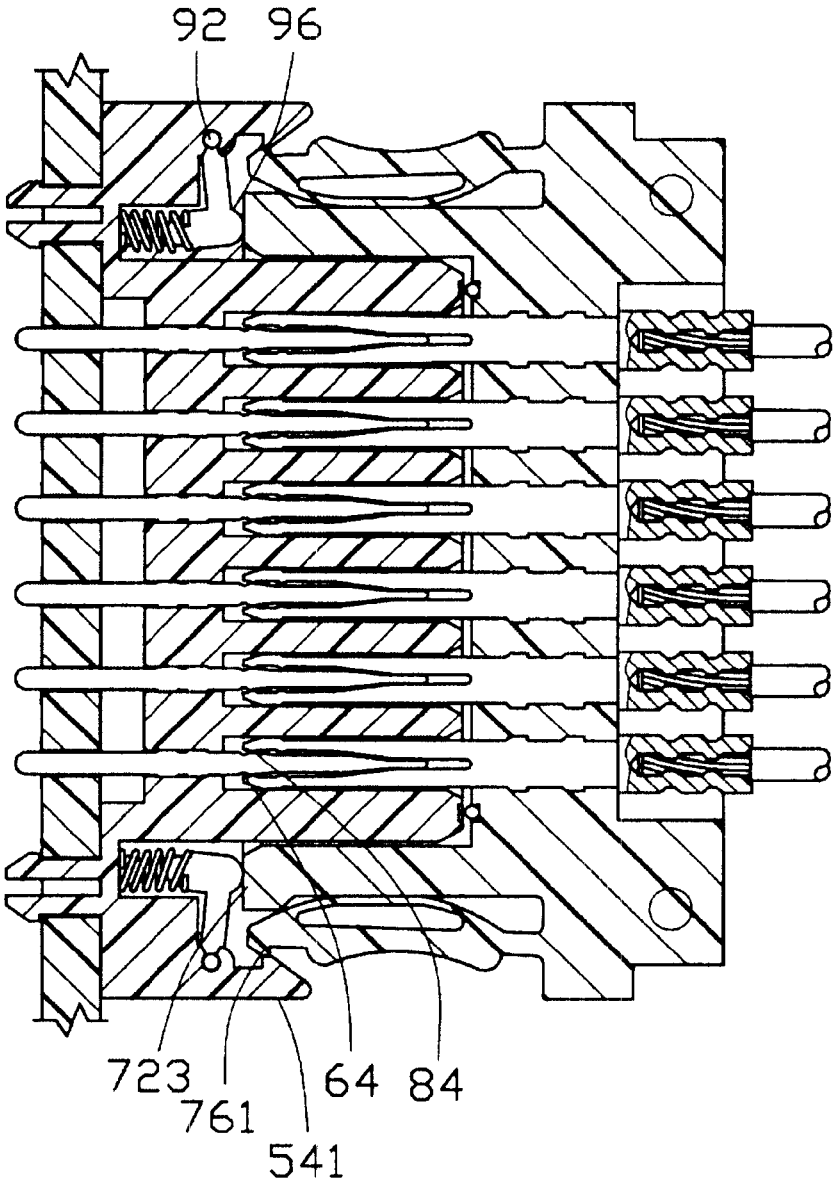
FIG. 12 is a schematic cut-away of the electrical connector assembly of FIG. 1 partially mating.

In use, referring to FIGS. 11–13, a user grasps the female connector 40, pressing inward on the actuation portions 762, and sliding the barrel portion 72 of the female connector 40 over the body 52 of the male connector 30. As the female connector 40 is pushed inward against the male connector 30, the mating portions 62 of the contacts 60 in the male connector 30 slide between the tines 85 of the terminals 80 in the female connector 40. At the same time, the rams 723 at the forward end of each side wall 721 of the female housing 70 push against the push knobs 96 of the levers 90 assembled in the male housing 50. The push knobs 96 are pushed backward, compressing the springs 98 as the levers 90 rotate about the axle stubs 92. Also at the same time, outward-facing edges (not labeled) of the second hooks 761 on the second latches 76 of the female housing 70 begin to ride up over inward-facing edges (not labeled) of the first hooks 541 of the male housing 50.

As the user pushes the female connector 40 to its fully connected position with the male connector 30, the locking bosses 84 on the tines 85 of the female connector's terminals 80 lock into corresponding dimples 64 and engage with corresponding transitions 65 of the contacts 60 in the male connector 30. Simultaneously, the second hooks 761 on the female connector 40 ride past the first hooks 541 on the male connector 30, and the second latches 76 lock with the first latches 54 as the user releases pressure on the actuation portions 762 of the second latches 76. This final push of the female connector 40 against the male connector 30 will have compressed the springs 98 to their locked position length. The force exerted by the springs 98 against the levers 90 in this state will be greater than the combined mating forces between all the contacts 60 and all the terminals 80. Thus, the force applied by the springs 98 against the levers 90, and thus by the levers 90 against the rams 723 of the female connector 40, is great enough to unmate the female connector 40 from the male connector 30. Unmating is prevented by the locking of the first and second latches 54,76 together.

To unmate the connectors 30,40, the user need only apply a force inward against the actuation portions 762 of the second latches 76 great enough to unlock the first and second latches 54,76. The springs 98 will then push the levers 90 against the rams 723 on the female connector 40 hard enough to break the locking of the locking bosses 84 in the dimples 64, and will push the female connector 40 away from the male connector 30.

A first advantage of this electrical connector assembly 20 is that the male contacts 60 are reliably held in connection with the female terminals 80, even under conditions of shock and vibration, since the locking bosses 84 lock into the dimples 64 and thereby prevent movement of the mating portions 62 of the contacts 60 relative to the mating portions 82 of the terminals 80. This relative movement is prevented not only in the axial direction (along the longitudinal axis of each contact 60/terminal 80) but also in the lateral direction (perpendicular to the plane defined by the two tines 85 of each terminal 80). Another advantage is the ease of unmating of the connectors 30,40, making this a quick release design. A further advantage is the simplicity of the design of the connectors 30,40, which should make the electrical connector assembly easier and cheaper to manufacture.

Obvious modifications to the above described electrical connector assembly 20 include combining the terminals 80 with the male housing 50 and the contacts 60 with the female housing 70. Variations in the mounting ends of the terminals 80 and contacts 60 are also easily foreseeable, so that the contacts 60/terminals 80 can be mounted to different conductors or board combinations. For example, the male connector 30 having contacts 60 or terminals 80 with sleeves at the mounting ends could be mounted to cables similar to the cables 100, and the female connector 40 with terminals 80 or contacts 60 could likewise be mounted to a printed circuit board or other media with conductors, such as flexible ribbon cable, by using appropriately modified mounting ends. The terminals 80 could also comprise three or more tines 85 for receipt of two or more mating portions 62 therebetween, the mating portions 62 being formed on the forward end of a single mating contact 60.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly for use in a high shock/vibration environment, comprising:

a male connector comprising:

an insulative male housing having a first latch on at least one side thereof; and a plurality of contacts mounted within the male housing, each contact having a male mating portion in the shape of a rod with at least one dimple defined in at least one side of the male mating portion; and a female connector for mating with the male connector, comprising:

an insulative female housing having a second latch on at least one side thereof, the second latch being engagable with the first latch; and a plurality of terminals mounted within the female housing, each terminal having a female mating portion in the shape of a tuning fork, comprising a pair of parallel tines engagable with the rod-shaped male mating portion of a corresponding contact of the male connector, the rod-shaped male mating portion fitting between the pair of tines of the female mating portion, the pair of tines having at least one locking boss protruding from at least one of the pair of tines, corresponding in position with the at least one dimple and engagable with the dimple;

wherein, when the male and female connectors are mated together, the first latch engages with the second latch, holding the male and female housings together, and, at the same time, the at least one locking boss of each terminal engages with the at least one corresponding dimple of each corresponding contact, holding the male mating portion of each contact in reliable engagement with the female mating portion of a corresponding terminal and preventing relative movement in the longitudinal direction of each terminal and each contact, and preventing relative movement in a lateral direction defined perpendicular to a plane defined by the two tines of each female mating portion;

wherein the at least one locking boss is on the male contacts and the corresponding at least one dimple is in the female terminals;

wherein the at least one locking boss protruding from at least one of the pair of tines is a pair of locking bosses protruding inwardly from each tine of the female mating portion, and the at least one dimple in at least one side is a pair of dimples and a pair of transitions in the sides of the male mating portion, and the pair of transitions and the pair of dimples engage with the two pairs of locking bosses in each mating contact and terminal;

wherein the first latch on at least one side of the male housing is a pair of first latches, one on each side of the male housing, and the second latch on at least one side of the female housing is a pair of second latches, one on each side of the female housing;

further comprising at least a lever and a spring assembled to the male housing and at least a wall forming a part of the female housing, the lever comprising an axle, a spring seat, and a push knob, the axle being rotatably engagable with the male housing and allowing the lever to rotate about the axle, the spring having two ends and the spring seat being engagable with one end of the spring, a second end of the spring being engagable with the male housing, wherein, during mating of the female and male connectors, the wall of the female housing pushes against the push knob, causing the spring to compress between the spring seat and the male housing, and the spring is held in compression during mating of the connectors by engagement of,the first and second latches, and when the first and second latches are released from engagement with each other, the force of the compressed spring is great enough to overcome the mating forces between the plurality of contacts and the plurality of terminals, causing the male and female connectors to unmate;

wherein the at least a lever and a spring are a pair of levers and a pair of springs, and the at least one wall of the female housing is two walls;

wherein the male housing comprises a body at a front thereof, the body having a plurality of channels into which the male mating portions of the contacts protrude;

wherein the female housing has a barrel portion at a front thereof into which the female mating portions of the terminals protrude and the barrel portion includes the two walls of the female housing, and when the male and female connectors mate, the barrel portion of the female housing slides over the body of the male housing and the two walls of the barrel portion each push against a push knob of a corresponding lever assembled in the male housing, each lever compressing a corresponding one of the two springs.

* * * * *